United States Patent [19]

Gwyn

[11] 4,081,968

[45] Apr. 4, 1978

[54] MINING OIL SHALE AND BACKFILLING WITH MECHANICALLY COMPRESSED SPENT SHALE

[75] Inventor: John E. Gwyn, Katy, Tex.

[73] Assignee: Shell Oil Company, Houston, Tex.

[21] Appl. No.: 768,933

[22] Filed: Feb. 16, 1977

[51] Int. Cl.[2] ..... E02D 17/04

[52] U.S. Cl. ..... 61/35; 61/.5

[58] Field of Search ..... 61/35, 36; 299/11; 208/11 R; 100/35

[56] References Cited

U.S. PATENT DOCUMENTS

| | | | |
|---|---|---|---|
| 3,588,175 | 6/1971 | Whiting | 299/11 |
| 3,665,716 | 5/1972 | Rogers et al. | 61/35 |

OTHER PUBLICATIONS

The Washington Post of Aug. 31, 1973, PA 12.

*Primary Examiner*—Jacob Shapiro

[57] ABSTRACT

The producing of shale oil by mining and retorting oil shale is improved by compressing the spent shale into a mass that is capable of both fitting within the mined out volume and supporting the overburden.

5 Claims, 1 Drawing Figure

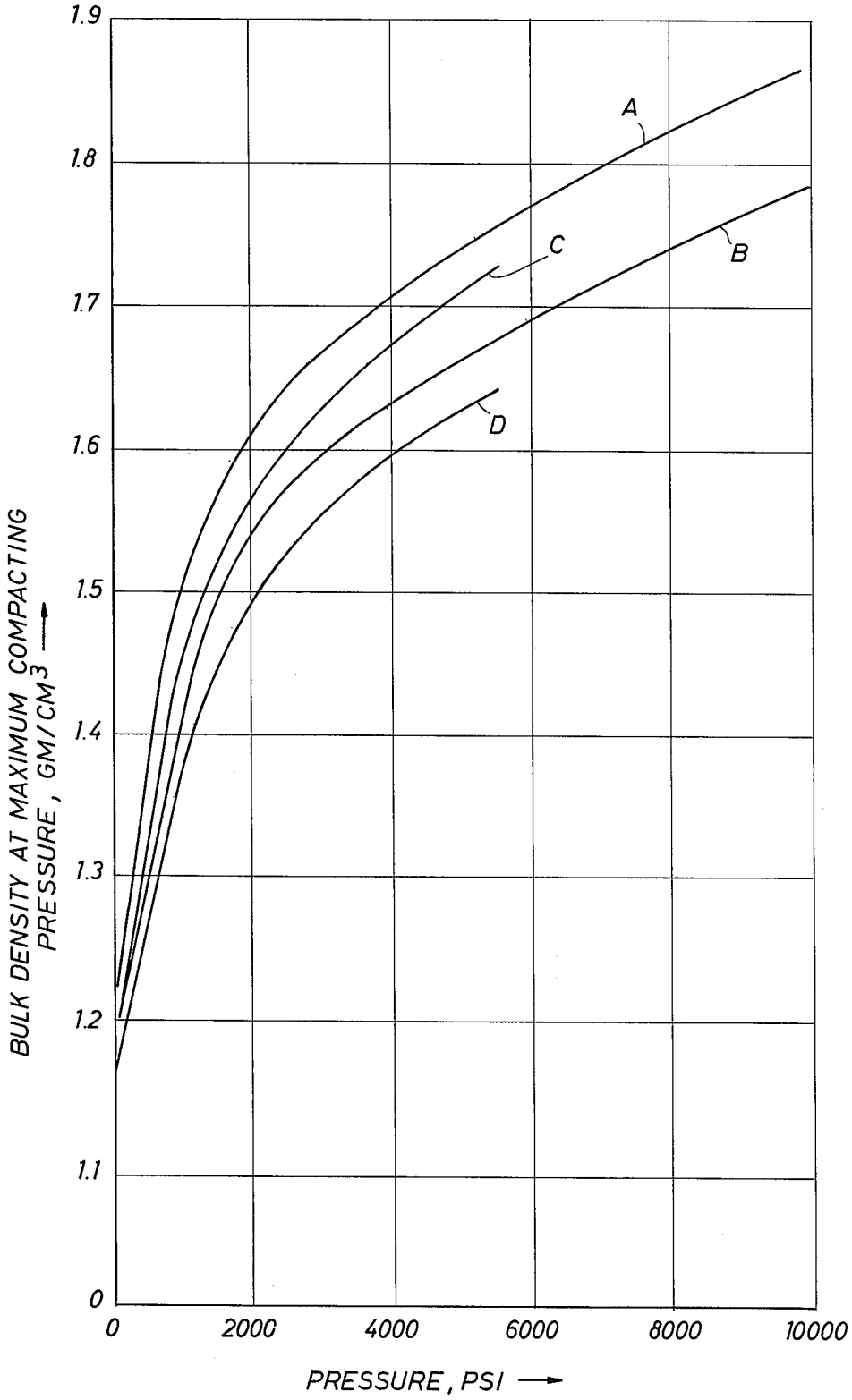
1.9
1.8
1.7
1.6
1.5
1.4
1.3
1.2
1.1
0
A
B
C
D
BULK DENSITY AT MAXIMUM COMPACTING PRESSURE, GM/CM3
0
2000
4000
6000
8000
10000
PRESSURE, PSI

MINING OIL SHALE AND BACKFILLING WITH MECHANICALLY COMPRESSED SPENT SHALE

BACKGROUND OF THE INVENTION

This invention relates to producing shale oil by mining a subterranean deposit of oil shale. More particularly it relates to an improved process for disposing of the spent mineral materials which are left by the retorting or pyrolyzing of the oil shale to produce the shale oil.

Various procedures have been suggested for replacing spent oil shale materials in the voids formed within the subterranean oil shale deposit. For example, U.S. Pat. No. 3,340,693 suggests mining oil shale and backfilling at least some of the mined out spaces with porous masses of particles through which a suitable reagent is flowed to consolidate the masses. U.S. Pat. No. 3,459,003 suggests mining and retorting oil shale, pumping a slurry containing some of the spent shale into the mine to form a porous mass, thermally converting the remainder of the spent shale to a cement, and pumping a slurry of the cement into the mine to fill the pores of the porous mass of spent shale. U.S. Pat. No. 3,588,175 suggests dividing a zone being mined into a number of production levels, mining concurrently on several levels while leaving relatively weak pillars between adjacent stopes, then promptly providing bulkheads and pumping slurries of spent shale into the emptied stopes while removing water to allow the spent shale masses to compact under their own weight.

The National Technical Information Service PB-254 728, Feb. 20, 1976, on Field Compaction Tests, Research and Development Program on the Disposal of Retorted Oil Shale-Paraho Oil Shale Project, describes compaction characteristics of the spent shale relative to treatments with various types and techniques used for road beds or dams, compacting devices such as sheepsfoot or rubber tire rollers, vibratory pads, tractors, or the like. The report indicates that the densities of the compacted spent shales were about 1.5 gm/cc. Such compactions leave about a 20% excess of bulk volumes relative to the bulk volumes of the subterranean oil shale from which the spent shales were obtained.

SUMMARY OF THE INVENTION

The present invention relates to a process for recovering shale oil by mining a subterranean deposit of oil shale. Portions of the oil shale are removed and retorted. Spent shale is mechanically compacted to a volume at least substantially as small as that of the in situ volume of the portion of oil shale from which the spent shale was obtained. And, compacted spent shale is disposed within a mined out portion of the subterranean oil shale.

DESCRIPTION OF THE INVENTION

The present invention is, at least in part, premised on the following discovery. The spent shale remaining after retorting or pyrolyzing an oil shale, to convert substantially all of the kerogen to shale oil components which are removed, can be compressed to a significant extent by mechanical squeezing. Only an economically feasible expenditure of energy is required to compress the spent shale into a volume at least substantially as small as the volume occupied by the uncrushed oil shale within the subterranean deposit. For example, it appears that the energy required for compressing the spent shale from an oil shale having about a 35 gallon per ton assay, need be only about 1 horsepower per 1,000 tons per day of shale oil production.

This was unobvious. The volume relationships between the oil shale in a subterranean deposit and the spent shale remaining after the oil shale is retorted are such that the disposal of the spent shale is a serious problem. For example, as indicated in U.S. Pat. No. 3,459,003, even if all of the spent shale from the amount of oil shale needed for a typical 100,000 barrels per day shale oil production operation were to be slurried and then de-watered and allowed to compress under its own weight within a mined out vertical void within the oil shale deposit, the volume of the unreturnable excess would amount to about 10-acre feet per day. This would cause the height of a one-acre pile to increase by 10 feet per day.

In the present process, the mined out oil shale can be retorted by substantially any retorting or pyrolyzing procedure that converts most if not all of the oil shale kerogen to shale oil materials which are removed and leaves a primarily inorganic residue or spent shale. Numerous procedures and techniques for conducting the retorting and oil recovering steps are currently known and available.

The spent oil shale can be compressed by mechanically squeezing particles of it into a mass having a volume at least substantially as small as that of an uncrushed portion of the oil shale from which it was obtained. With respect to spent shales obtained by retorting an oil shale of about 35 gallon per ton assay, such a compression can readily be obtained by applying about 8,000 pounds per square inch for times as short as 1 minute or less. Numerous devices and techniques for effecting such a compression are known and currently available.

The compression can be applied to hot or cold spent shale at the retorting site and can be conducted immediately after the retorting, or after a significant delay. The spent shale can be transported, by conveyor belt or containers, to the mine site for compression in situ, e.g., behind the lateral advancing tunnel face of a long-wall mining procedure. Alternatively, the spent shale can be slurried with a suitable liquid, preferably water, and pumped into the mine site to there undergo a concurrent de-watering and compression. Where the spent shale is compressed at the retorting site, pill or briquette-like blocks of the compressed shale can be transported into the mine and disposed within the mined out voids in masses arranged so that any significant lowering of the mine roof is opposed by the compressive strength of the compressed spent shale. Such masses of compressed shale can be stacked within or squeezed into vertical passages or stopes as well as in voids along the back sides of tunnels being laterally advanced.

In accordance with the present invention, portions of a subterranean oil shale deposit can be mined out by substantially any procedure adapted to remove oil shale particles and transport them to a surface location. Numerous devices and techniques are known and currently available. The mining operations can be conducted on one or several levels by means of room and pillar and/or long wall and/or cut and fill types of mining operations.

Compression tests were made to determine what pressures would be required for the consolidation of a typical spent shale. The samples used were obtained by retorting a subterranean oil shale having a 35 gallon per ton assay, a density of about 2.1 grams per centimeter, a 1.806 gram per centimeter Fischer assay oil-free density, and a porosity of about 29%, with a skeletal inorganic density of about 2.56 grams per cc. The retorting was conducted at a temperature of about 900° F for about 20 minutes to 1½ hours total heating time to provide a spent shale which was substantially free of any organic material other than a trace of carbon. The compression tests included pressing 10 gram samples of the spent shale in a 1-inch diameter piston of a cylindrical pill press.

The drawing shows plots of the variations in bulk density with pressure of five 10-gram samples. Curve A represents such a sample which contained 1.5 grams of water and was compressed under pressures that were increased to 10,000 psi. Curve B shows the essential identical results of duplicate samples (water free) pressed under pressures increased to 10,000 psi, and curves C and D show the results of two additional water-free samples pressed under pressures increased to 5,000 psi.

The initial densities of the samples varied due to the way the samples were introduced into the dye. However, such variations seemed to have little correlation with the compressed densities. In addition to having a higher density, the wetted sample had a shinier, darker and smoother appearance.

It will be noted that the greatest compaction tends to occur at less than about 1,000 psi. The samples were squeezed into the original in situ volume of the oil shale from which they were derived by pressures of about 8,000 psi. The test samples had a skeletal inorganic density of about 2.56 and the experiments indicate that such spent shales can be further compacted to substantially that density by an application of additional pressure. Samples were held at the above maximum pressures for several minutes to see if further compression occurred, but only a slight further compression occurred, for about 15 to 30 seconds, then ceased. The further compression amounted to about ½% or less.

Such tests indicate that a spent oil shale can readily be compacted to a mass capable of supporting the overburden. For example, in regions in which the pressure gradient of the overburden is about 1 it appears that such compacted shales could support an overburden of at least about 10,000 feet, when such spent shales have been compressed under 10,000 psi and squeezed into a mass extending from the floor to the roof of a mined out void within the oil shale deposit.

What is claimed is:

1. In a shale oil production process in which portions of a subterranean oil shale are mined out and retorted at a surface location, the improvement comprising, compressing substantially all of the spent shale to a volume at least substantially as small as that of the in situ volume of the oil shale from which the spent shale was derived, under a pressure of more than about 1,000 psi, and disposing the compressed spent shale within a mined out portion of the deposit.

2. The process of claim 1 in which the spent shale is compressed in situ within the mine.

3. The process of claim 2 in which the spent shale is compressed under a pressure of at least about 10,000 psi.

4. The process of claim 1 in which the spent shale is suspended in an aqueous liquid and pumped into the mine and there concurrently compressed and dewatered in situ.

5. The process of claim 1 in which the spent shale is compressed into blocks on the surface which blocks are stacked within the mine.

* * * * *